United States Patent [19]

Ishizuka et al.

[11] 4,437,861

[45] Mar. 20, 1984

[54] COAL-DEASHING PROCESS

[75] Inventors: Tetsuo Ishizuka; Hiroshi Hotta; Yoshichika Nishimura, all of Kyoto, Japan

[73] Assignee: Dai-Ichi Kogyo Seiyaku Co., Ltd., Kyoto, Japan

[21] Appl. No.: 467,063

[22] Filed: Feb. 16, 1983

[30] Foreign Application Priority Data

| | | | |
|---|---|---|---|
| Feb. 19, 1982 | [JP] | Japan | 57-26586 |
| Feb. 19, 1982 | [JP] | Japan | 57-26587 |
| Feb. 19, 1982 | [JP] | Japan | 57-26588 |
| Feb. 19, 1982 | [JP] | Japan | 57-26589 |

[51] Int. Cl.[3] ..... C10L 5/04; C10L 10/06

[52] U.S. Cl. ..... 44/1 R; 44/15 R; 44/51

[58] Field of Search ..... 44/1 A, 15 R, 1 B, 51, 44/1 R

[56] References Cited

U.S. PATENT DOCUMENTS

| | | | |
|---|---|---|---|
| 2,780,538 | 2/1957 | Chilton | 44/51 |
| 2,894,851 | 7/1959 | Booth et al. | 44/6 |
| 4,304,573 | 12/1981 | Burgess et al. | 44/51 |

FOREIGN PATENT DOCUMENTS

| | | | |
|---|---|---|---|
| 62843 | 4/1981 | European Pat. Off. | 44/51 |
| 55-47158 | 10/1980 | Japan | 44/51 |
| 56-73436 | 5/1981 | Japan | 44/51 |
| 2037318 | 7/1980 | United Kingdom | 44/1 B |

*Primary Examiner*—Delbert E. Gantz
*Assistant Examiner*—Chung K. Pak
*Attorney, Agent, or Firm*—Millen & White

[57] ABSTRACT

Natural coal containing inorganic impurities may be deashed by the selective flocculation process using a novel flocculant which is a water-soluble or water-dispersible copolymer having a molecular weight from about 100,000 to about 30,000,000 comprising a hydrophilic monomeric unit having a solubility in water greater than 15% by weight at 20° C. and a hydrophobic monomeric unit having a solubility in water less than 10% by weight at 20° C. in proportions of 99:1 to 20:80% by weight.

5 Claims, No Drawings

COAL-DEASHING PROCESS

BACKGROUND OF THE INVENTION

This invention relates to a process for deashing coal by selectively flocculating finely divided coal particles in an aqueous suspension thereof mixed with particles of inorganic impurities.

Petroleum has long been consumed as a major energy source because of its low price, high heat value and easy handling in transportation and combustion. Its increasing price and shortage of resources in recent years, however, have led attempts to utilize coal again as a substitute energy source for petroleum.

As is well-known, natural coal generally contains in addition to the carbonaceous content from 5 to 25% of ash contents composed of a major proportion of clay ashes such as silica and alumina, and a minor proportion of various metal oxides and sulfides. These ash contents leave a large quantity of unburned residue and produce environmentally harmful substances when combusted. It is for this reason that a high ash content greatly decreases the value of coal as a fuel.

In order to deash natural coal as much as possible and improve its value, several methods have been known including the heavy media separation process, the floatation process, the oil agglomeration process and the magnetic separation process. Among them, the most effective process is the oil agglomeration process in which an amount of a binding oil is added to an aqueous slurry of finely divided coal particles mixed with impurity particles to selectively agglomerate coal particles into pellets. This process requires a significant quantity of oil and energy for pelletizing the coal particles and the deashing rate achievable by this process does not exceed 50–60%. Another disadvantage of this process is the fact that the resulting deashed coal particles are in the form of a mixture with oil which is less convenient than aqueous slurries in transporting and combusting as such. Various attempts have been made, therefore, to obviate these and other defects by, for example, adding an emulsifying agent, an inorganic electrolyte or an oil-soluble polymer in combination with the oil binder, adding the oil binder as an emulsion or stepwise. Experiments have shown that the results of these attempts are far less than would be satisfactory.

Japanese laid-open patent application No. 54-16511 discloses a direct deashing process wherein ash particles are selectively sedimentated by adding to an aqueous slurry of finely divided coal particles a dispersing agent such as a water-soluble polyacrylate or polyphosphate. This process utilizes the difference between sedimentating speeds of the ash particles and the coal particles under the gravity but is difficult to operate satisfactorily in practice.

Japanese laid-open patent application No. 56-111062 discloses a deashing process of coal by chemically graft-polymerizing an unsaturated monomer with coal particles to render the coal particles more lipophilic and recovering the same. This process requires additional reagents and also cumbersome operations making its commercial application unsuitable.

It has been proposed to selectively flocculate a variety of mineral particles including coal using a water-soluble polymer having hydrophobic groups such as high molecular weight (500,000) polyethylene glycol and acrylamide-methyl acrylate copolymer. However, the requisite properties and conditions required for the flocculant used in this technique, particularly for use in coal have not been fully revealed.

It is, therefore, the major object of the present invention to provide a process for deashing coal by the selective flocculation technique which can avoid the foregoing defects inherent in the prior art processes and achieve a high deashing rate with a simple operation at a low reagent consumption.

SUMMARY OF THE INVENTION

The present invention relates to a process for deashing coal containing inorganic impurities comprising the steps of preparing an aqueous suspension of finely divided particles of coal mixed with said inorganic impurities; adding to said suspension an effective amount of a selective flocculent; allowing said coal particles to flocculate selectively as flocs while leaving the remainder containing said inorganic impurities suspended; and recovering said flocs from said suspension. The suspension may contain a conventional dispersing agent.

According to the present invention, said selective flocculant consists of a water-soluble or water-dispersible copolymer having a molecular weight from 100,000 to 30,000,000, preferably from 500,000 to 20,000,000.

The constituent monomeric units of said copolymer comprises:

A. at least one hydrophilic monomer having a solubility in water greater than 15% by weight at 20° C., and B. at least one hydrophobic monomer having a solubility in water less than 10% by weight at 20° C.

The proportions of the hydrophilic and hydrophobic monomers in the copolymer are from 99:1 to 20:80, preferably from 97:3 to 40:60% by weight.

One of important advantages of the present invention is the fact that it enables a high deashing rate with a low energy consumption. For example, the deashing rate which may be achieved by the process of this invention reaches higher than 70% at a coal recovery rate of 90–100%, while the prior art processes may only achieve a deashing rate of 50–60% at the same coal recovery rate. When the coal recovery rate is decreased to less than 90% in the process of the present invention, the deashing rate may be increased to higher than 90% which would otherwise be impossible to achieve.

Another advantage is the fact that the resulting coal flocs is oil-free and may be easily resuspended in water in the form of a slurry which is convenient for transportation and combustion.

DETAILED DESCRIPTION OF THE INVENTION

Examples of the above-mentioned hydrophilic monomeric unit include:

(1) acrylamide, methacrylamide and their derivatives, such as acrylamide, methacrylamide, diacetone acrylamide, 2-acrylamido-2-methylpropanesulfonic acid and a salt thereof, and N-methylolacrylamide;

(2) acrylic acid, methacrylic acid, their water-soluble salts and esters, such as acrylic acid, methacrylic acid, their sodium salts, 2-hydroxyethyl methacrylate, N,N-dimethylaminoethyl methacrylate and its quaternary ammonium salts;

(3) water-soluble allyl compounds such as allyl alcohol, allyl sulfonic acid and a salt thereof, methallyl sulfonic acid and a salt thereof, and diallylamine;

(4) polymerizable unsaturated dicarboxylic acids and their salts, such as maleic acid, maleic anhydride, fumaric acid, itaconic acid and their salts;
(5) vinyl alcohol;
(6) vinyl sulfonic acid and its salts; and
(7) styrene sulfonic acids and their salts, such as p-styrenesulfonic acid and its salts.

Examples of the above-mentioned hydrophobic monomeric unit include;

(1) alkyl esters of acrylic acid and methacrylic acid, such as methyl acrylate, ethyl acrylate, propyl acrylate, butyl acrylate, n-octyl acrylate, 2-ethylhexyl acrylate, octadecyl acrylate, methyl methacrylate, ethyl methacrylate, propyl methacrylate, butyl methacrylate, n-octyl methacrylate, 2-ethylhexyl methacrylate and octadecyl methacrylate;
(2) polymerizable unsaturated nitriles such as acrylonitrile;
(3) styrene and its homologues, such as styrene and methylstyrene;
(4) polymerizable halogenated olefins such as vinyl chloride, vinyl bromide, vinylidene chloride, vinylidene bromide and vinylidene fluoride;
(5) vinyl esters of aliphatic acids such as vinyl acetate, vinyl propionate, vinyl caprate and vinyl oleate;
(6) polymerizable olefins such as ethylene, propylene and 1-butene; and
(7) vinyl pyridines such as 2-methyl vinyl pyridine.

Water-soluble or water-dispersible copolymers may be directly prepared by copolymerizing appropriate comonomers in a conventional manner. Alternatively, they may be prepared from an appropriate precursor copolymer by a chemical conversion process such as hydrolysis, neutralization and the like. The copolymer may be either a block copolymer or a random copolymer.

The copolymer will not be selectively adsorbed on the coal particles when the proportion of the hydrophobic unit is less than 1%, while the copolymer will not be sufficiently soluble or dispersible in water when the proportion of the hydrophilic unit is less than 20% by weight.

The amount of the copolymer needed depends on various parameters such as coal concentration, levels of coal recovery and deashing rates and generally lies between 0.1 ppm to 1% by weight based on the entire slurry.

The starting aqueous slurry of coal particles may contain a dispersing agent. The use of a suitable dispersing agent aids the ash particles to be uniformly dispersed and retained in the suspension for a long period of time. Examples of suitable dispersing agents include polyphosphates such as sodium hexametaphosphate, silicates such as sodium silicate, sodium polyacrylate, formaldehyde-sodium naphthalenesulfonate condensate and the like. The amount of the dispersing agent is usually less than 5,000 ppm and preferably from 50 to 2,000 ppm based on the entire slurry. Excessive use of the dispersing agent often has an adverse effect on the selective flocculation of coal particles.

The process of the present invention is applicable to various types of coal such as lignite, subbituminous coal, bituminous coal, semianthracite and anthracite. Washings of mined coal containing coal particles may also be employed.

Mined coal blocks are finely divided to an average particle size less than 150 microns, preferably 100 microns and then suspended in water. The wet disintegration process is preferable for safety reason though the dry process may be employed as desired.

The total concentration of mixed particles in the suspension is usually less than 60%, preferably 2 to 30%. The achievable deashing rate is inversely proportional to the total particle concentration. A concentration higher than 60% is no more attractive for this reason.

The pH of the coal suspension is adjusted between 3 to 12, preferably between 7 and 11.

Preferably, a stock solution of the above-mentioned water-soluble copolymer is preliminarily prepared at a concentration from 0.5 to 5%. This stock solution is added to the aqueous suspension with gentle stirring. The selective flocculation of coal particles will occur with continued stirring for few minutes after the addition of the flocculant and then the suspension is allowed to stand. The deashed coal particles are aggregated as flocs by the above process, while unwanted ash particles as well as a small amount of coal particles remain suspended in water. Deashed coal may be recovered from the treated suspension, for example, by decantation and further dewatered in a centrifuge or alternatively resuspended in water using a relatively large amount of a dispersing agent.

The mother liquor from which deashed coal has been recovered may be processed as in the previous cycle to recover the remaining coal particles.

The invention is further illustrated by the following examples in which all percents are by weight.

The starting coal processed in these examples is shown in Table 1.

TABLE 1

| | Coal | | | |
|---|---|---|---|---|
| | Bituminous | | | Subbituminous |
| | I | II | III | IV |
| Industrial Analysis: | | | | |
| $H_2O$, % | 7.0 | 1.2 | 7.8 | 23.5 |
| Ash, % | 8.5 | 16.1 | 24.3 | 10.5 |
| Volatile Content, % | 28.1 | 8.6 | 32.2 | 47.5 |
| Non-volatile Carbon, % | 56.4 | 74.0 | 35.7 | 18.5 |
| Elementary Analysis: | | | | |
| C, % | 83.5 | 72.0 | 63.1 | 69.1 |
| H, % | 4.8 | 2.5 | 4.4 | 5.1 |
| N, % | 1.0 | 0.9 | 0.7 | 0.8 |
| S, % | 0.9 | 0.4 | 0.5 | 0.2 |
| Particle Size: | | | | |
| 300 mesh passing, % | 95.2 | 96.3 | 95.2 | 93.0 |
| 300 mesh retained, % | 4.8 | 3.7 | 4.8 | 7.0 |
| 145 mesh passing, % | 99.4 | 99.9 | 99.5 | 98.7 |

Remarks:
Analysis was conducted according to JIS M 8811-8813.

EXAMPLE 1

Each type of coal in Table 1 was disintegrated in a ball mill in the presence of water to obtain an aqueous slurry of finely divided coal particles which were occupied mostly by particles of less than 46 micron size and all by particles of less than 105 microns.

One liter of an aqueous slurry of finely divided coal particles having a given concentration shown in Table 2 was placed in a vessel equipped with four buffle plates and a six-blade stirrer. The slurry was adjusted at pH 11.0 with sodium hydroxide and nitric acid and an amount of sodium hexametaphosphate was added to the slurry to a concentration of 300 ppm. The slurry was then stirred at 3,000 RPM for two minutes to obtain a uniform suspension.

A 0.5% preformed stock solution of the copolymer listed in Table 2 was added to the suspension to a copolymer concentration shown in Table 2 requiring for 15 seconds. The suspension was then stirred at 3,000 RPM for one minute and at 1,000 ppm for two minutes successively, and allowed to stand stationarily.

The resulting flocs were dewatered by decantating and then centrifuging at 1,000 RPM for 3 minutes. The results obtained are shown in Table 2.

TABLE 2

| Coal | Water-soluble copolymer: Amount, ppm | Hydrophilic unit (A) | Hydrophilic unit (B) | A/B | M.W. | Coal recovery, % | Deashing rate, % |
|---|---|---|---|---|---|---|---|
| I | 10 | acrylamide | methyl acrylate | 50/50 | $15 \times 10^6$ | 98.3 | 80.3 |
| I | 10 | " | butyl methacrylate | 80/20 | $5 \times 10^6$ | 93.2 | 86.2 |
| I | 10 | " | 2-ethylhexyl acrylate | 90/10 | $3 \times 10^6$ | 91.1 | 85.3 |
| I | 10 | " | octadecyl acrylate | 90/10 | $3 \times 10^6$ | 90.8 | 80.4 |
| I | 15 | " | styrene | 80/20 | $3 \times 10^6$ | 95.9 | 85.6 |
| II | 50 | " | acrylonitrile | 90/10 | $1 \times 10^6$ | 90.8 | 82.1 |
| III | 100 | " | vinyl chloride | 90/10 | $0.5 \times 10^6$ | 92.9 | 75.3 |
| IV | 100 | " | vinyl acetate | 85/15 | $0.5 \times 10^6$ | 90.3 | 78.9 |
| II | 40 | " | 1-butene | 90/10 | $1 \times 10^6$ | 93.2 | 79.9 |
| I | 10 | methacrylamide | methyl acrylate | 85/15 | $5 \times 10^6$ | 91.1 | 83.3 |
| I | 10 | " | 2-ethylhexyl methacrylate | 90/10 | $5 \times 10^6$ | 92.1 | 79.2 |
| I | 10 | sodium acrylate | methyl acrylate | 90/10 | $3 \times 10^6$ | 90.0 | 82.5 |
| II | 30 | " | styrene | 90/10 | $2 \times 10^6$ | 92.3 | 80.5 |
| II | 30 | " | acrylonitrile | 90/10 | $2 \times 10^6$ | 92.2 | 75.3 |
| II | 50 | " | vinyl acetate | 80/20 | $1 \times 10^6$ | 90.6 | 70.0 |
| II | 20 | " | 2-methyl vinyl pyridine | 90/10 | $3 \times 10^6$ | 93.9 | 81.8 |
| I | 10 | acrylamide/sodium acrylate = 80/5 | methyl acrylate | 85/15 | $5 \times 10^6$ | 95.8 | 78.9 |
| I | 10 | sodium p-styrene sulfonate | methyl acrylate | 70/30 | $5 \times 10^6$ | 92.4 | 84.1 |
| II | 60 | sodium p-styrene sulfonate | 1-butene | 90/10 | $1 \times 10^6$ | 95.2 | 75.0 |
| I | 40 | sodium allyl sulfonate | butyl methacrylate | 80/20 | $1 \times 10^6$ | 90.1 | 85.6 |
| II | 50 | allyl sulfonic acid | styrene | 80/20 | $1 \times 10^6$ | 93.2 | 82.1 |
| IV | 30 | sodium vinyl sulfonate | 2-ethylhexyl acrylate | 90/10 | $2 \times 10^6$ | 93.4 | 79.1 |
| II | 50 | sodium vinyl sulfonate | vinyl acetate | 70/30 | $1 \times 10^6$ | 96.3 | 75.8 |
| III | 20 | sodium itaconate | octadecyl acrylate | 90/10 | $3 \times 10^6$ | 92.8 | 71.1 |
| II | 20 | " | 2-methyl vinyl pyridine | 70/30 | $3 \times 10^6$ | 94.1 | 86.6 |
| III | 30 | " | acrylonitrile | 80/20 | $2 \times 10^6$ | 93.5 | 75.3 |
| IV | 50 | " | vinyl chloride | 90/10 | $1 \times 10^6$ | 91.1 | 73.2 |

Remarks:

$$\text{Coal recovery (\%)} = \frac{\text{Coal content in deashed coal}}{\text{Coal content in starting coal}} \times 100$$

$$\text{Deashing rate (\%)} = \left(1 - \frac{\text{Ash content in deashed coal}}{\text{Ash content in starting coal}}\right) \times 100$$

EXAMPLE 2

Example 1 was repeated at varying concentrations of both coal particles and the water-soluble copolymer at varying pH values.

The copolymer used was an acrylamide-methyl acrylate copolymer (80/20) having a molecular weight of 5,000,000.

The results obtained are shown in Table 3.

TABLE 3

| Coal | Concentration, % | Concentration of water-soluble copolymer, ppm | pH | Coal recovery, % | Deashing rate, % |
|---|---|---|---|---|---|
| II | 3 | 5 | 9.0 | 90.3 | 95.1 |
| II | 10 | 10 | 9.0 | 92.4 | 83.5 |
| II | 20 | 50 | 9.0 | 94.3 | 71.4 |
| II | 30 | 100 | 9.0 | 96.2 | 70.0 |
| III | 10 | 20 | 7.0 | 92.7 | 73.2 |
| III | 10 | 20 | 9.0 | 93.1 | 75.9 |
| III | 10 | 20 | 11.0 | 93.3 | 75.6 |
| IV | 5 | 20 | 10.0 | 90.1 | 83.2 |

The above has been offered for illustrative purposes only, and it is not for the purpose of limiting the scope of this invention which is defined in the claims below.

We claim:

1. A process for deashing coal containing inorganic impurities which comprises the steps of:

preparing an aqueous suspension of finely divided particles of coal mixed with said impurity particles;

adding to said suspension an effective amount of a water-soluble or water-dispersible copolymer having a molecular weight from about 100,000 to about 30,000,000 of a hydrophilic monomeric unit having a solubility in water greater than 15% by weight at 20° C. and a hydrophobic monomeric unit having a solubility in water less than 10% by weight at 20° C., the proportions of said hydrophilic unit and said hydrophobic unit in said copolymer being a ratio from 99:1 to 20:80 parts by weight;

flocculating said coal particles selectively as flocs while leaving the remainder containing said inorganic impurities suspended; and recovering said flocs from said suspension.

2. The process according to claim 1, wherein said hydrophilic monomeric unit is selected from an amide, a water-soluble salt or a water-soluble ester of acrylic or methacrylic acid, a water-soluble allyl compound, a polymerizable unsaturated dicarboxylic acid or a salt thereof, vinyl alcohol, vinyl sulfonic acid or a salt thereof, a styrene sulfonic acid or a salt thereof, and said hydrophobic monomeric unit is selected from an alkyl ester of acrylic or methacrylic acid, styrene or a derivative thereof, a polymerizable nitrile, a polymerizable olefin, a polymerizable halogenated olefin, a vinyl ester of aliphatic acid or a vinyl pyridine.

3. The process according to claim 1, wherein said aqueous suspension of finely divided coal particles contains a dispersing agent.

4. The process according to claim 1, wherein said aqueous suspension of finely divided coal particles has a solid content of less than 60% by weight.

5. The method according to claim 1, wherein said water-soluble or water-dispersible copolymer is added to a concentration from 0.1 ppm to 1% by weight.

* * * * *